United States Patent [19]

Zemsky

[11] 4,175,346

[45] Nov. 27, 1979

[54] FIREARM AND BULLET IDENTIFICATION

[76] Inventor: Michael D. Zemsky, P.O. Box 2965, Arlington, Va. 22202

[21] Appl. No.: 833,970

[22] Filed: Sep. 16, 1977

[51] Int. Cl.[2] ..... F41C 21/00; F41F 17/10

[52] U.S. Cl. ..... 42/76 R; 42/1 A; 42/78

[58] Field of Search ..... 42/1 A, 1 R, 78, 76 R

[56] References Cited

U.S. PATENT DOCUMENTS

| | | | |
|---|---|---|---|
| 460,102 | 9/1891 | Carver | 42/78 |
| 804,483 | 11/1905 | Lincoln | 42/78 |
| 1,275,669 | 8/1918 | Forbes | 102/92.7 |
| 1,650,908 | 11/1927 | Ramsey | 102/38 R |
| 3,442,172 | 5/1969 | Wehrmann | 42/76 R |
| 3,525,172 | 8/1970 | Marshall et al. | 42/78 |
| 3,562,945 | 2/1971 | Mikola | 42/78 |
| 3,777,385 | 12/1973 | Hagen | 42/76 R |
| 4,035,942 | 7/1977 | Wiczer | 42/1 A |

*Primary Examiner*—Charles T. Jordan

[57] ABSTRACT

A firearm having marking elements as an integral part of its bore surface which are arrayed according to a code indicating the identification number of the firearm so that any bullets fired therefrom will bear markings corresponding to the marking element array which markings will indicate the identification number of the firearm. The marking elements being an integral part of the firearm cannot be removed without damaging or disabling the firearm. A wide variety of marking element arrays are possible so that a large number of identification numbers may be encoded.

23 Claims, 10 Drawing Figures

Fig. 1
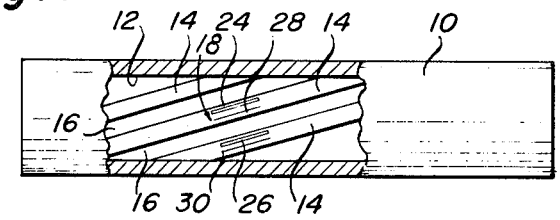
Fig. 5
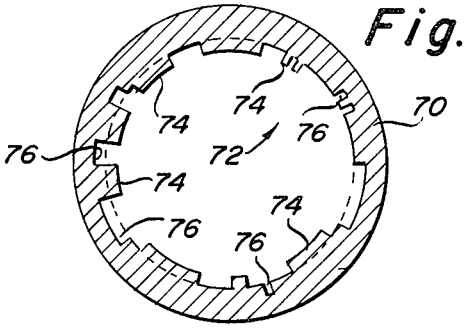
Fig. 2
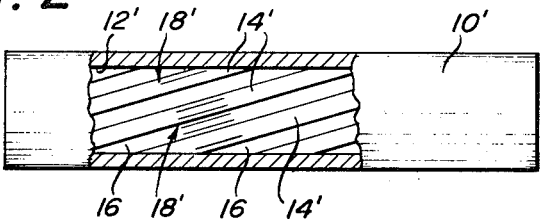
Fig. 6
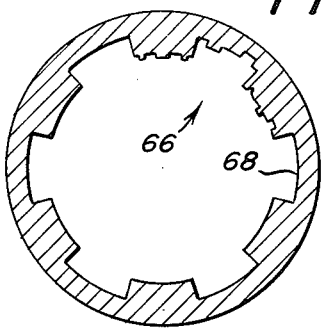
Fig. 3
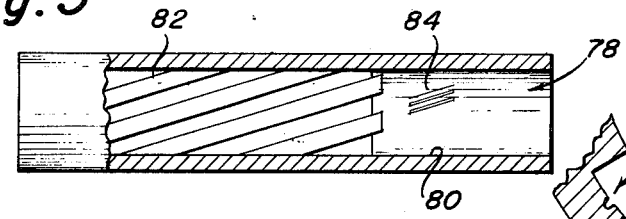
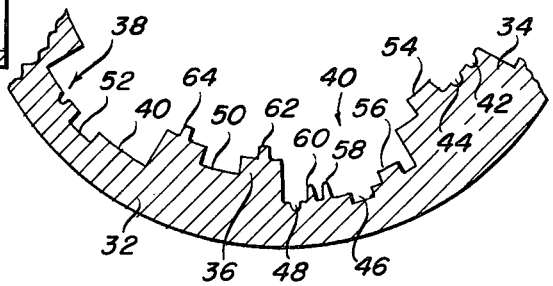
Fig. 7
Fig. 4
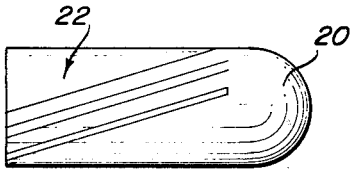
Fig. 8
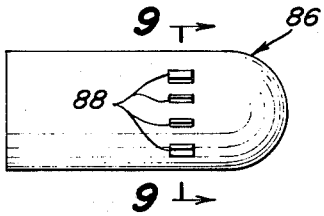
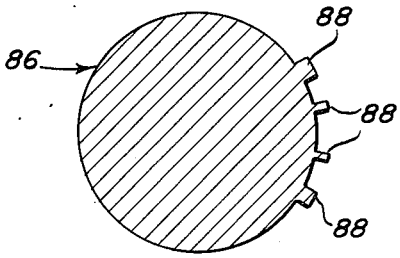
Fig. 9
Fig. 10
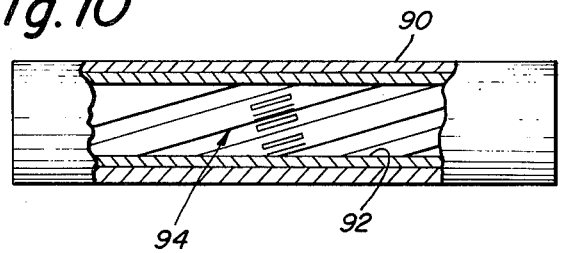

FIREARM AND BULLET IDENTIFICATION

FIELD OF THE INVENTION AND BACKGROUND

This invention generally relates to the field of firearms and is concerned with a means for applying identifying data to a firearm and to any bullets fired therefrom.

Usually, in order to link a bullet with the firearm that fired it, a number of suspect firearms must be test fired, the fired bullets retrieved and the markings made by the bores of the respective firearms on the bullets compared to the markings on the previously fired bullet.

It would greatly facilitate such ballistic identification procedures if a positive identification could be made with only the fired bullet available. Many firearms have identification numbers. The problem presented by the prior art is to find some way to place that identification number on each bullet as it is fired and to insure that this means for applying the identification number cannot be easily tampered with or removed without damaging or rendering unusable the firearm.

Additionally, with unremovable identifying indicia, it will be extremely difficult to obscure the ownership or origin of a particular firearm by removing or altering the identifying indicia.

A system similar to certain embodiments of the present system has been proposed by U.S. Pat. No. 4,035,942 to Wiczer in which bullets are labeled by placing in a groove in the barrel bore a channeled ring containing a number of die bars which will impart markings to the bullets which pass over them. The die bars are assembled in different combinations according to a preset code which corresponds to the firearm's serial number. Among the problems with such an insert is that it can be removed and its arrangement of die bars rearranged or removed completely and an attempt made to fill in the groove in the barrel.

SUMMARY OF THE INVENTION

An object of this invention is to provide another structure placing marking elements in the bore of a firearm's barrel.

An object of this invention is to make marking elements which are an integral part of the firearm bore which cannot be removed without damaging the barrel and disabling the firearm so that bullets fired therefrom will always be marked thereby and so that the identification number of a firearm may always be read.

A further object of this invention is to provide a method for the application of identifying indicia to already manufactured firearms.

Another object of this invention is to provide a system which will enable a manufacturer to place identifying indicia within a barrel bore in a single operation.

An additional object of this invention is to provide for a greater number of permutations in marking element arrangements than previously possible by using the lands and grooves of rifled bores together with the marking elements to indicate different identifying numbers.

Still another object of this invention is to use both protrusions and indentations to label bullets to increase the number of labeling permutations.

The invention comprises a firearm which will mark a bullet fired therefrom with identifying markings having a barrel with marking elements on the bore surface which are an integral part of the barrel and bore surface so that they cannot be removed without damaging or disabling the firearm. These marking elements are arrayed according to a predetermined code so as to indicate the identifying number of the firearm. When a bullet is fired from that firearm, the bullet will have markings applied to its surface corresponding to the marking element array which markings will indicate the identification number of the firearm. The marking elements may also be read directly without firing a bullet to determine the identifying number of the firearm.

BRIEF DESCRIPTION OF THE DRAWINGS

FIG. 1 is a side elevational view partially in section of a firearm barrel having the marking elements of this invention.

FIG. 2 is a side elevational view partially in section of another firearm barrel having a different array of marking elements from the barrel of FIG. 1.

FIG. 3 is a side elevational view partially in section of a third firearm barrel having the marking elements of this invention.

FIG. 4 is a side elevational view of a bullet bearing the markings produced by the marking elements of this invention.

FIG. 5 is a cross-sectional view of a firearm barrel.

FIG. 6 is a cross-sectional view of a firearm barrel.

FIG. 7 is an enlarged fragmentary sectional view of a firearm barrel showing an array of marking elements according to the invention.

FIG. 8 is a side elevational view of a bullet used to imprint the marking elements on the bore surface of a firearm barrel.

FIG. 9 is a sectional view taken along the line 9—9 of FIG. 8 and viewed in the direction of the arrows.

FIG. 10 is a side elevational view partially in section of a firearm barrel having the marking elements of this invention.

DETAILED DESCRIPTION

A firearm barrel 10 with a bore extending the length thereof has on the bore surface 12 rifling in the form of a series of spiral lands 14 and grooves 16. Situated on the lands 14 are a series of marking elements 18 comprising raised areas or protrusions which are parallel to the longitudinal direction of the lands 14 and grooves 16. These marking elements 18 are an integral part of the substrate metal of the barrel 10 formed in and from the substrate metal, not attachments or inserts.

Any bullet fired through the barrel 10 in addition to being marked by the lands 14 and grooves 16 of the rifling will have marked on its surface lines corresponding to the arrangement and the dimensions of the marking elements 18.

FIG. 4 shows a marked bullet 20 having markings 22 produced by a different array of marking elements. This bullet 20 has no rifling markings for clarity.

The arrangement or array of marking elements 18 may be varied in a number of ways.

The width of the individual marking elements 18 may be varied as may the distance between successive marking elements 18. As shown in FIG. 1, marking elements 24 and 26 are wider than marking elements 28 and 30 and produce correspondingly similar markings on a bullet passing over them. Additionally, the distances between the marking elements 24 and 28 and between the elements 26 and 30 are much less than the distance between 26 and 28.

The marking element arrays can be varied by varying the locations of the marking elements 18 about the lands 14 and grooves 16 of a rifled barrel. In FIG. 1 the marking elements 18 are situated only on the surfaces of the lands 14 while in FIG. 2 marking elements 18' appear both on the surfaces of the lands 14' and the grooves 16'.

Additionally, the number of the lands 14 and grooves 16 used to carry marking elements 18 may be varied. Marking elements 18 only appear on two lands 14 in the barrel 10 of FIG. 1 but on three lands 14' and one groove 16' in the barrel 10' of FIG. 2.

Additional arrays are made possible through the use of two different types of marking elements which may be either a protrusion or an indentation on the surface of the bore.

Any array may consist of protrusions alone or indentations alone or be a combination of the two types.

A better appreciation of the use of protrusions and identations as well as of the number of arrays possible can be had by reference to FIG. 7 which shows a portion of a rifled barrel 32 having lands 34, 36 and grooves 38, 40 on its bore surface.

The lands 34, 36 and grooves 38, 40 have on their surfaces an array of marking elements consisting of identations 42, 44, 46, 48, 50, 52 and protrusions 54, 56, 58, 60, 62, 64. The protrusions vary in width as shown by large protrusions 54, 56 and small protrusions 58, 60, 62, 64. The indentations also vary in width as shown by small indentations 42, 44, 48 as opposed to large indentations 46, 50, 52. The marking elements can also be distinguished by their locations on the lands 34, 36 and grooves 38, 40. Lands 34, 36 have a large protrusion 54, small protrusions 62, 64, large indentation 50 and small identations 42, 44. Grooves 38, 40 have large protrusion 56, small protrusions 58, 60, large indentations 46, 52 and small identation 48. An array 66 of marking elements similar to the array of FIG. 7 is shown in the context of a whole barrel bore 68 in FIG. 6.

Using this variety of possible arrays a code can be established in which marking elements are organized in such a manner that individual numerals and letters are assigned to certain combinations of marking elements.

Most firearms have identification numbers which are usually a series of numerals or a combination of numerals and letters. Using the predetermined code, the identification number of a firearm is represented on the bore surface of the firearm in the form of an array of marking elements.

Any bullet fired from that firearm will be marked with markings corresponding to that firearm's array of marking elements. Using the code, the identity of the firearm from which a bullet came can be determined by reading the bullet surface.

The particular code used is not a part of this invention so has not been elaborated on. An appropriate code can be arrived at by anyone skilled in the art.

While the drawings show the marking elements disposed about only a portion of their barrels, the marking elements can be disposed about the entire circumference of a barrel bore or any portion thereof depending on the code used and the length of the identification to be imprinted.

The longitudinal length of the marking elements is not critical so long as the length is sufficient to insure proper marking of any bullets traveling through the bore.

The longitudinal length of the marking elements may be as long as the bore rifling itself. If barrel-long marking elements are to be used in a rifled bore, the rifling and marking elements could be combined, that is the rifling itself could function as the marking elements. Normally, rifling is uniform in its dimensions. Each land or groove is of the same dimensions as the next land or groove. However, by varying the dimensions of the lands and grooves in a manner similar to that for the marking elements and establishing a code for these variations, the rifling itself may function as the identification marking means. Such a rifling array is shown in FIG. 5 in which a barrel 70 has rifling 72 with lands 74 and grooves 76 of varying dimensions which encode the identification number of the firearm.

While the discussion thus far has largely concerned the use of marking elements with rifled bores, they may also be used with smooth bore barrels. The marking elements in a smooth bore are disposed parallel to the longitudinal axis of the bore unlike in the rifled bore since the bullets traveling through a smooth bore will not be spinning.

The marking elements may also be used in a bore which is rifled for only a portion of its length. In this case the marking elements can be situated on the smooth portion of the bore. If the smooth portion is situated after the rifled portion, the marking elements are aligned parallel to the longitudinal direction of the lands and grooves of the rifling. Such a bore 78 is shown in FIG. 3 in which the bore 78 has smooth and rifled portions, 80 and 82 respectively, and the marking elements 84 are aligned with the rifled portion 82 of the bore 78.

The marking elements may also be used with tapered barrels in which the bore decreases in diameter towards the muzzle. To insure clear markings on the bullet, the marking elements are best located on the bore surface close to the muzzle.

The barrel of which the marking elements form an integral part may be of any standard construction. The barrel may be one cylindrical piece of metal or, referring to FIG. 10, a composite of concentric cylinders or sleeves 90, 92 in which one sleeve is heat shrunk about another. In this latter situation the innermost cylinder 92 would comprise a bore liner 92 and the marking elements 94 would be an integral part of that bore liner 92. This bore liner 92 is not to be confused with an insert. Rather it is a standard and essential part of the barrel construction which lines the entire bore and bears the bore rifling on its interior surface when a firearm is rifled.

It is an essential feature of the invention that the marking elements be an integral part of the bore. They are formed in and from the bore surface. In that way they are difficult to file or rub down without damaging or destroying the barrel and rifling. Further, tampering within the barrel is usually far beyond the skills and resources of the average firearm user. Even if not disabling the firearm, attempts to tamper with the marking elements will dramatically reduce the accuracy of the firearm.

Methods for manufacturing firearm barrels having marking elements as an integral part thereof are available in the art and will permit a manufacturer to place marking elements within a barrel in a single operation. Some of these methods are also applicable to the placing of marking elements in already manufactured firearms.

A tube to be rifled and imprinted with marking elements can be compressed on an appropriately shaped mandrel by drawing the tube and mandrel through a compressing die.

A bore also may be imprinted with marking elements through the application of a swaging tool.

The marking elements can be formed electrolytically as may the bore rifling. To do this portions of the bore surface which will be raised areas are coated with a masking material while the unprotected surfaces are subjected to controlled anodic dissolution.

Marking elements can also be formed through the use of carefully guided precision drills.

FIGS. 8 and 9 show a bullet 86 which functions in a manner similar to a swaging tool in imprinting marking elements on a bore surface. The bullet 86 has on its surface elements 88 of a substance harder than the bore metal. Upon the bullet's being fired through a barrel, these elements 88 will imprint a corresponding pattern of marking elements on the bore surface.

The marking elements may also be formed by appropriate molding, pressing, or etching techniques.

The marking elements once formed can be "read" in other ways besides firing a bullet and reading the bullet's markings.

Such as reading would be necessary in a situation where the firearm itself needs to be identified, not a bullet, and the only identifying indicia are located within the barrel.

An appropriately designed mechanical probe can be used to measure the relative locations and dimensions of the marking elements.

Pressure-sensitive paper such as carbon paper can be used to "read" a firearm barrel. A paper cut to fit the bore is lightly placed in the bore. An instrument with bristles and a long handle is placed down the bore and rubbed against the sides of the bore. The marking elements will make imprints on the paper and, after removal, the paper can be read.

The marking elements can also be read by placing a settable material into the bore which will produce a removable imprint of the bore surface.

Alternatively, coloring materials may be coated on the bore surface. These colors will fill indentations and can be viewed or photographed. Ultraviolet or X-ray reactive compositions may be used in a similar fashion.

While this invention has been described as having a preferred design, it will be understood that it is capable of further modification. This application, is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A firearm which will mark a bullet fired therefrom with identifying markings, comprising:

(a) a firearm having a barrel with a bore;

(b) marking elements formed from the material of said bore, said marking elements being an integral part of said bore surface; and (c) said marking elements arranged according to a predetermined code so as to indicate the identifying number of that firearm whereby a bullet fired from said firearm will have markings applied to its surface corresponding to the marking element array which markings will indicate the identification number of said firearm.

2. The firearm of claim 1 wherein said marking elements are protrusions and indentations on the surface of said bore.

3. The firearm of claim 1 wherein said marking elements are protrusions on the surface of said bore.

4. The firearm of claim 1 wherein said marking elements are indentations on the surface of said bore.

5. The firearm of claim 1 wherein said bore is rifled having lands and grooves.

6. The firearm of claim 5 wherein said marking elements are located on said lands and said grooves.

7. The firearm of claim 6 wherein said marking elements are protrusions and indentations on the surface of said bore and said protrusions and said indentations are both located on said lands and said grooves.

8. The firearm of claim 1 wherein said bore is smooth.

9. The firearm of claim 1 wherein said bore is rifled for a portion of its length while the remaining portion is smooth and said marking elements are situated on said smooth portion.

10. The firearm of claim 1 wherein said barrel is a composite of concentric cylinders having an inner cylinder which comprises a bore liner and said marking elements are an integral part of said bore liner.

11. The firearm of claim 1 wherein said marking elements are arrayed to indicate the identifying number of said firearm by varying the widths of said marking elements and the distances between them.

12. The firearm of claim 1 wherein said marking elements are arrayed to indicate the identifying number of said firearm by varying the distances between said marking elements while the widths of said marking elements remain constant.

13. The firearm of claim 1 wherein said bore is rifled having lands and grooves and said marking elements consist of said lands and said grooves.

14. The firearm of claim 13 wherein said lands and said grooves are arrayed to indicate the identifying number of said firearm by varying the distances between said grooves.

15. The firearm of claim 13 wherein said lands and said grooves are arrayed to indicate the identifying number of said firearm by varying the widths of said grooves.

16. The firearm of claim 5 wherein said marking elements are situated on said lands only.

17. The firearm of claim 5 wherein said marking elements are situated in said grooves only.

18. The firearm of claim 1 wherein said bore decreases in diameter towards the muzzle of said firearm and said marking elements are located close to said muzzle.

19. A firearm which will mark a bullet fired therefrom with identifying markings, comprising:

(a) a firearm having a barrel with a rifled bore, said bore having lands and grooves;

(b) marking elements on the surface of said bore on said lands and grooves, said marking elements being an integral part of said barrel; and (c) said marking elements arrayed according to a predetermined code so as to indicate the identifying number of that firearm whereby a bullet fired from said firearm will have markings applied to its surface corresponding to the marking element array which markings will indicate the identification number of said firearm.

20. The firearm of claim 19 wherein said marking elements are protrusions and indentations on the surface of said bore and said protrusions and said indentations are both located on said lands and said grooves.

21. A firearm which will mark a bullet fired therefrom with identifying markings, comprising:

(a) a firearm having a barrel with a bore;

(b) marking elements on the surface of said bore, said marking elements being an integral part of said barrel;

(c) said marking elements arrayed according to a predetermined code so as to indicate the identifying number of that firearm whereby a bullet fired from said firearm will have markings applied to its surface corresponding to the marking element array which markings will indicate the identification number of said firearm;

(d) said bore being rifled having lands and grooves; and (e) said marking elements comprising said lands and grooves.

22. The firearm of claim 21 wherein said lands and said grooves are arrayed to indicate the identifying number of said firearm by varying the distances between said grooves.

23. The firearm of claim 21 wherein said lands and said grooves are arrayed to indicate the identifying number of said firearm by varying the widths of said grooves.

* * * * *